US006058873A

United States Patent [19]

Koyanagi

[11] Patent Number: 6,058,873

[45] **Date of Patent: *May 9, 2000**

[54] HULL CONSTRUCTION FOR SMALL WATERCRAFT

[75] Inventor: Tomoyoshi Koyanagi, Iwata, Japan

[73] Assignee: Yamaha Hatsudoki Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/717,636

[22] Filed: Sep. 23, 1996

[30] Foreign Application Priority Data

Sep. 21, 1995 [JP] Japan ..... 7-243440
Oct. 31, 1995 [JP] Japan ..... 7-283810

[51] Int. Cl.[7] ..... B63B 1/32

[52] U.S. Cl. ..... 114/291; 114/55.5

[58] Field of Search ..... 114/56, 271, 283, 114/123, 363, 270, 288–292, 55.5; D12/300, 310–314, 317

[56] References Cited

U.S. PATENT DOCUMENTS 1,024,682 4/1912 Fauber ..... 114/291
4,023,353 5/1977 Hall ..... 440/89
4,619,215 10/1986 Wood et al. ..... 114/271
4,672,905 6/1987 Pipkorn ..... 114/56
4,945,852 8/1990 Kobayashi ..... 114/363
5,078,072 1/1992 Horiuchi et al. .
5,199,367 4/1993 Horiuchi et al. .
5,218,922 6/1993 Kobayashi ..... 114/363
5,255,626 10/1993 Hattori et al. .
5,401,197 3/1995 Kobayashi .
5,406,904 4/1995 Kobayashi .
5,443,026 8/1995 Wenstadt et al. ..... 114/56
5,452,676 9/1995 Fiore ..... 114/291
5,474,014 12/1995 Russell .
5,490,474 2/1996 Ikeda .
5,540,174 7/1996 Kishi et al. .
5,685,253 11/1997 Alexander, Jr. .

*Primary Examiner*—Ed Swinehart
*Attorney, Agent, or Firm*—Knobbe, Martens, Olson & Bear, LLP

[57] ABSTRACT

A personal watercraft includes an improved hull design which reduces drag on the watercraft and inhibits porpoising of the watercraft at high speeds, while providing adequate buoyancy when the watercraft is at rest. The watercraft hull includes a pair of steppers positioned toward the aft end of the watercraft hull. The rear stepper has a greater height than the front stepper. This design reduces the wetted area of the hull when the watercraft is up on plane. The second stepper, however, provides additional surface contact should the watercraft to porpoise in order to stabilize the watercraft. The hull design also includes improved foot steps and adjustable sponsons. The foot steps are sloped upwardly in order to provide greater control of the watercraft when leaning the watercraft in a turn.

53 Claims, 8 Drawing Sheets

HULL CONSTRUCTION FOR SMALL WATERCRAFT

BACKGROUND OF THE INVENTION

1. Field of the Invention

The present invention relates to small watercrafts, and in particular to a hull construction for a small watercraft.

2. Description of Related Art

Personal watercrafts have become very popular in recent years. A personal watercraft is designed to be operated by a rider who sits in a straddle-like fashion at a central position on the watercraft. Some personal watercrafts also have seating for one or two passengers. For this purpose, the personal watercraft includes an upper deck section with an elongated bench which the rider and passengers straddle. The deck also includes foot areas which extend along both sides of the bench.

Over the past few years, a lower section of the personal watercraft hull has steadily evolved in an effort to optimize the speed and the handling of the small watercraft. The hull lower section now commonly has a deep "V" shape and often includes one or more inner chines between a keel line of the hull and the outer chines. The lower hull section is designed such that the watercraft planes or rides on only a portion of the lower hull section's surface area at the aft end of the watercraft. The wetted area of the watercraft hull (i.e., the portion of the watercraft hull in contact with the water) desirably is small in comparison to the total surface are of the hull lower section in order to reduce drag on the watercraft. For this purpose, watercraft's bow rises out of the water to reduce the wetted area when the watercraft is planing.

The angle formed between the bow and the surface of the body of water in which the watercraft is operated affects the drag or resistance experienced by the watercraft hull as it planes over the water surface. This angle is often referred to as the planing angle of the watercraft. Too large or small of an angle significantly increases drag on the watercraft hull. An optimal planing angle therefore exists in order to minimize drag on the watercraft.

Prior hull designs, however, most often are designed to raise the watercraft hull to a smaller than the optimum planing angle for the watercraft in order to minimize pitching of the watercraft. Prior watercrafts tend to pitch severely when planing with the bow raised to the optimum planing angle. That is, the bow of the watercraft tends to bounce up and down with the bow raised out of the water to the desired planing angle. This condition is commonly referred to as "porpoising" and produces a very uncomfortable ride. In addition, watercraft speed suffers because bow porpoising increases the drag on the watercraft. At a smaller angle, the watercrafts does not porpoise to a meaningful extent; however, drag on the watercraft increases with a smaller angle as compared with the planing optimum angle if it could be maintained.

SUMMARY OF THE INVENTION

A recent hull design, produced by the assignee hereof, introduced a stepper at the aft end of the hull in order to improve the stability of the watercraft when planing at the desired attack angle. A stepper is a vertical rise in the hull surface, as will be explained below in detail. The stepper reduces the wetted surface of the watercraft hull while effectively elongating the hull in order to improve the stability of the watercraft.

The present hull configuration incorporates a pair of steppers and a rounded transom in order to further stabilize the watercraft when up on plane and thereby inhibit porpoising of the watercraft when running at high speeds. The aft hull design also effectively reduces the wetted area of the watercraft hull when up on plane, while supporting the aft end of the deck and providing buoyancy at the watercraft aft end when in a static state. The dual stepper hull design also provides a rocker effect which permits the rider to pull the watercraft bow up earlier when jumping, for improved watercraft handling.

Thus, in accordance with one aspect of the present invention, there is provided a small watercraft including a hull formed by an upper deck and a lower hull. The lower hull includes a pair of inclined sections arranged generally in a V-shape. The inclined sections extend from a bow of the watercraft toward a transom of the watercraft. First and second steppers are formed in the lower hull between aft ends of the inclined sections and the transom of the watercraft.

Another aspect of the invention involves a small watercraft including a hull formed by an upper deck and a lower hull. The lower hull includes a pair of inclined sections arranged generally in a V-shape. The inclined sections extend in a longitudinal direction from a bow of the watercraft toward a transom on either side of a centerline of the watercraft. The upper deck including a pair of longitudinally extending foot areas. Each foot area is located on a side of the longitudinal centerline opposite the other foot area and includes a foot step. At least a portion of the foot step is inclined to slope upwardly in a direction away from the longitudinally centerline.

An additional aspect of the invention involves a small watercraft comprising a hull including at least one adjustable sponson. The adjustable sponson comprises a body which is movably attached to a side wall of the watercraft hull by at least one cam mechanism. The cam mechanism includes a support pin projecting from a side wall of the hull and a cam member. The cam member includes an eccentrically positioned hole through which the pin extends. A locking device is positioned on a side of the sponson body opposite of the hull side wall in order to secure the sponson body onto the side wall.

BRIEF DESCRIPTION OF THE DRAWINGS

These and other features of the invention will now be described with reference to the drawings of a preferred embodiments which are intended to illustrate and not to limit the invention, and in which.

DETAILED DESCRIPTION OF THE PREFERRED EMBODIMENTS OF THE INVENTION

Figure 1:
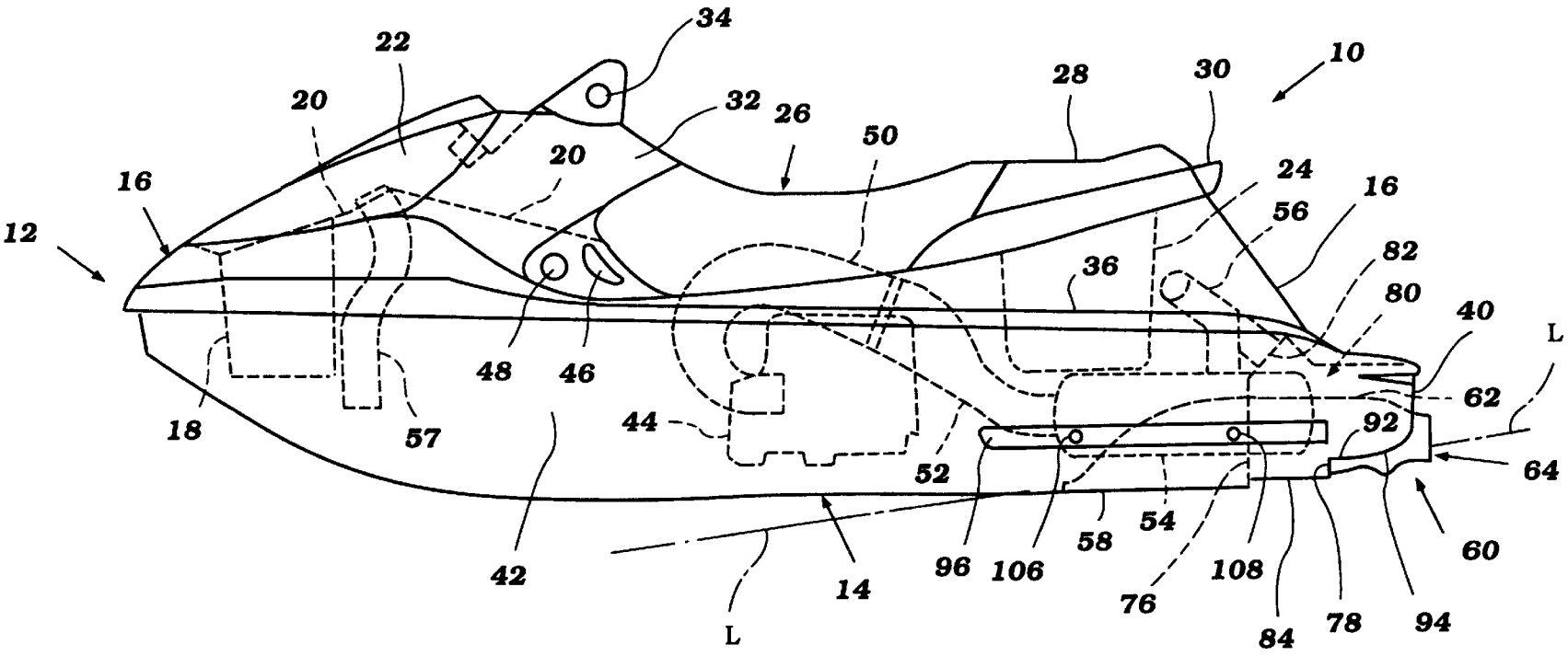
FIG. 1 is a side elevational view of a personal watercraft constructed in accordance with a preferred embodiment of the present invention.
Figure 2:
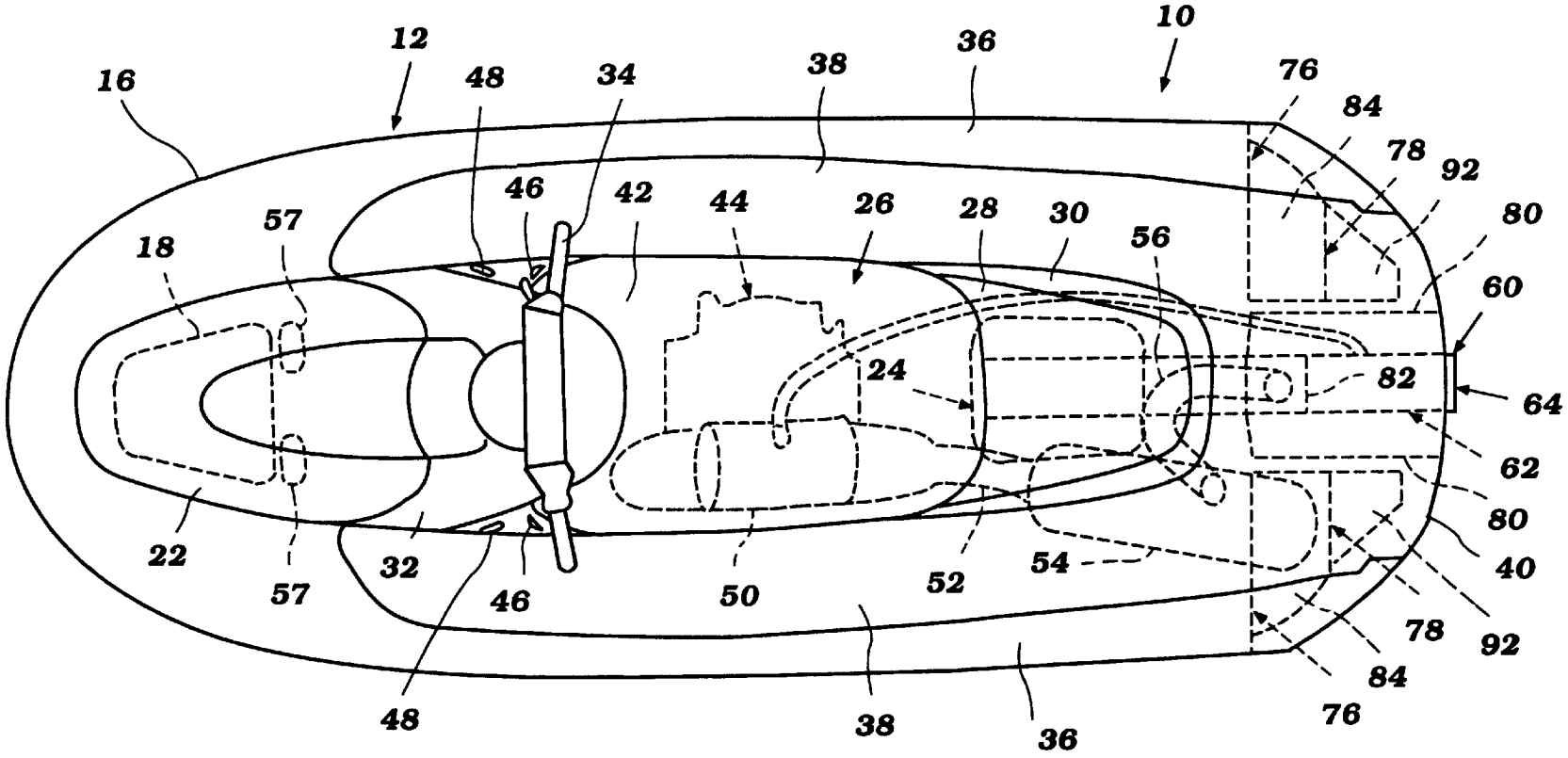
FIG. 2 is a top plan view of the personal watercraft of FIG. 1.

With reference initially to FIGS. 1 and 2, a personal watercraft is illustrated which includes a hull design constructed in accordance with a preferred embodiment of the present invention. The personal watercraft is identified generally by the reference numeral 10. The hull design has particular utility with personal watercrafts of the type illustrated; however, the hull design also can be used with other small watercrafts as well. The illustration of the hull design in connection with a personal watercraft therefore is merely exemplary.

The watercraft 10 includes a hull, indicated generally by the reference numeral 12, having a lower hull portion 14 and an upper deck assembly 16. The lower hull portion 14 includes the lower surfaces of the hull 12 and its construction will be discussed in detail later.

The upper deck assembly 16, includes the upper surfaces of the hull 12 and sealingly engages the lower hull 14 around its periphery in any suitable manner. A storage area 18 is defined by the upper deck 20 of the forward end of the upper deck assembly 16 and is sealed by a cover 22 that is affixed to the upper deck assembly 16 by any suitable means. In like manner, a further storage area 24 is defined by the rearward end of the upper deck assembly 16.

The upper deck assembly 16 has a rider's area 26 at its rear end in which a seat 28 which covers the rear storage compartment 24 is provided for accommodating one or more riders seated in straddle tandem fashion. A grab rail 30 is additionally provided at the rear of the seat 28 for more securely accommodating any rearwardly seated riders. An upstanding portion 32 of the upper deck assembly 16 is disposed forwardly of the rider's area 26 and is provided with a handlebar throttle assembly 34 for operating the watercraft 10 and its powering internal combustion engine.

A pair of raised gunnels 36 are formed at opposite sides of the rear portion of the upper deck assembly 16 and define a pair of foot areas 38 into which the riders may place their feet. The foot areas 38 extend longitudinally and open through the rear of a transom 40 to facilitate water drainage and also to permit ease of entry and exit of the watercraft 10 from the body of water in which the watercraft 10 is operating.

The hull 12 defines an engine compartment 42. An internal combustion engine identified by the reference numeral 44 is mounted in the engine compartment 42 underneath the rider's area 26 for powering the watercraft 10. The engine 44 has an induction system (not shown) which delivers a supply of atmospheric air from a pair of air inlets 46 located beneath the upstanding portion 32 of the upper deck assembly 16 and fuel from fuel tank (not shown) to the engine 44 in a ratio that is suitable for combustion. A pair of fuel inlets 48 are provided forward of the air inlets 46 through which the fuel tank is filled with fuel.

The engine 44 also has an exhaust system which exhausts the combustion products and the engine cooling water from the water jackets to the atmosphere. A combination exhaust manifold and expansion chamber 50 is mounted to one side of the engine 44 and extends first in an upwardly direction, then rearwardly and downwardly to connect at its lower end to an exhaust pipe 52 which connects to a water trap 54. A second exhaust pipe 56 connects to the side of the water trap 54 at its rearward end and terminates near the transom 40 of the watercraft 10 for discharging of the exhaust gases and engine coolant from the watercraft 10 into the body of water in which the watercraft 10 is operating.

The engine compartment 42 is also provided with a pair of ventilating shafts 57 which are affixed at their upper ends to the upper deck surface 20 and supply the engine compartment 42 with atmospheric air for ventilating the engine compartment 42.

A tunnel 58 is formed on the underside of the hull portion 14 at its rearward end. The through the rear of the transom 40 as is shown in FIG. 1. A jet propulsion unit identified by the reference numeral 60 is mounted within the tunnel 58 for propelling the watercraft 10. The jet propulsion unit 60 includes an impeller (not shown) which drives water from the body of water in which the watercraft 10 is operating. The impeller is affixed to an impeller shaft (not shown) which extends forwardly from the tunnel 58 into the engine compartment 42. The impeller shaft is coupled by means of a flexible coupling to an engine output shaft (not shown) for driving the impeller.

Water pumped by the impeller is discharged rearwardly through a discharge nozzle portion 62 of the jet propulsion unit 60. A pivotally supported steering nozzle 64 is supported in registry with the discharge nozzle 62 and is steered by the handlebar throttle assembly 34 for steering of the watercraft 10 in a well known manner.

Figure 3:
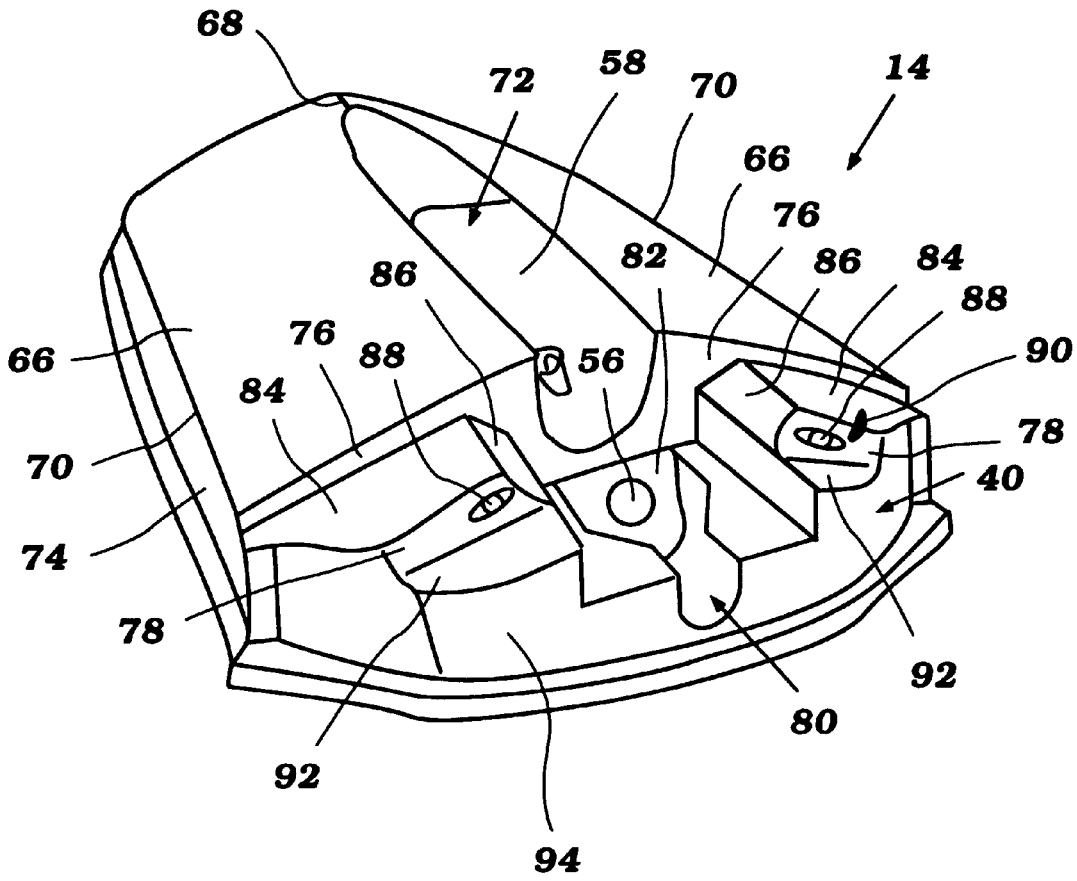
FIG. 3 is a bottom rear perspective view of the personal watercraft of FIGS. 1 and 2.

The construction of the lower hull 14 will now be discussed in detail. A coordinate system is provided, as illustrated in FIG. 3, in order to ease the description of the present hull design. A longitudinal axis extends between the bow and the stern and a lateral axis extends between the starboard and ports sides, lying perpendicular to the longitudinal axis. A vertical axis extends normal to both the lateral axis and the longitudinal axis.

The lower hull 14 is designed such that the watercraft planes or rides on a minimum surface area of the aft end of the lower hull in order to optimize the speed and handling of the watercraft. With this configuration, the bow or front of the watercraft extends forwardly out of the water at a desired planing angle to the surface of the body of water in which the watercraft is operating.

Figure 4:
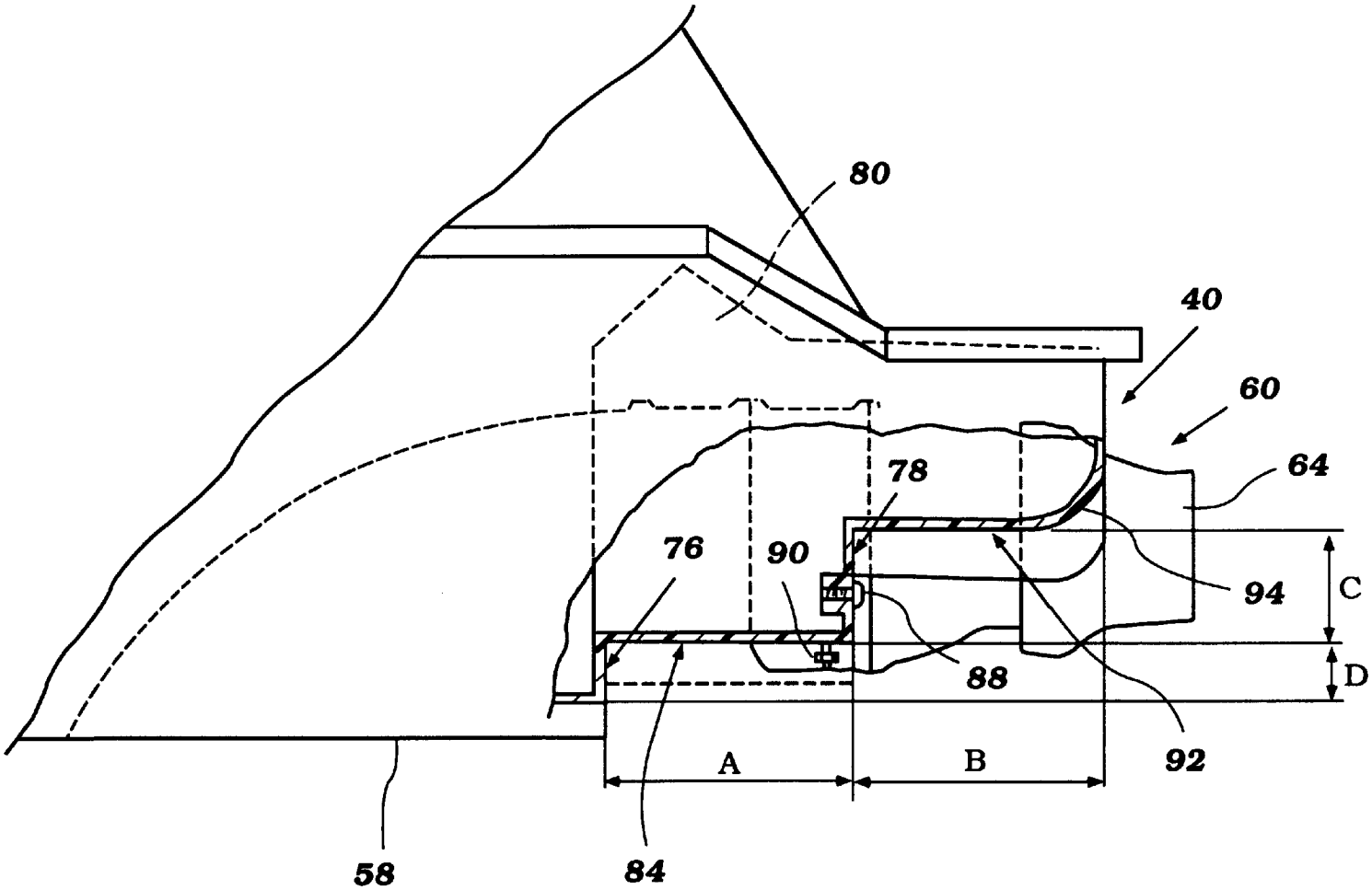
FIG. 4 is an enlarged side elevational view of the hull of the personal watercraft with portions of the lower hull shown in cross-section to illustrate an embodiment of the invention.

With additional reference now to FIGS. 3 and 4, the lower hull section 14 generally has a V-shape formed by a pair of inclined sections 66 which extend laterally outward from the keel line indicated at 68 to outer chines 70 at an angle which is referred to as the dead rise angle. At least a portion of the inclined sections 66 extend outwardly from a flat keel section 69 and at least a portion of the sections 66 extend outwardly from a central recess section 72 which forms a portion of the tunnel section 58 at the rear of the lower hull section 14. The inclined sections 66 extend longitudinally from the bow towards the transom 40 of the lower hull 14 and extend laterally to the longitudinally extending side walls 74 which are inclined more steeply than the inclined section 66 and are generally flat and straight near the stem of the lower hull 14 and smoothly bend towards the longitudinal center of the watercraft 10 at the bow. The lines of intersection between the inclined section 66 and the corresponding side walls 74 form the outer chines 70 of the lower hull section 14.

The aft ends of the inclined sections 66 terminate at first and second steppers that are indicated by the reference numerals 76 and 78, respectively, towards the transom end of the lower hull 14. The first stepper 76 extends upwardly normal to the inclined surfaces 66 and, as seen in FIG. 4, has a height that is indicated by the letter D. The first stepper 76 is bisected at the keel line 68 by a channel 80 formed in the transom 40 for accommodating the jet propulsion unit 60. Additionally, the second exhaust pipe 56 of the engine 44 terminates at an inclined wall 82 which defines the forward end of the channel 80.

The upper ends of the first stepper 76 located to the port and starboard of the channel 80 terminate at port and starboard first stepper areas 84 which extend between the first and second steppers 76 and 78 and are separated by the channel 80. The port and starboard first stepper areas 84 extend generally parallel to the aft ends of the port and starboard incline surfaces 66 and terminate at their inner ends at inclined surfaces 86 that define the longitudinal boundary of the channel 80 and at their outer ends at the side walls 74 of the lower hull 14. As seen in FIG. 4, the first stepper area 84 has a longitudinal length that is indicated by the letter A.

The second stepper 78 extends upwardly normal to the stepper area 84 and is bisected by the channel 80 into port and starboard portions. Drain holes 88 are disposed on both port and starboard portions of the second stepper 78 through which ventilated gases and any water in the engine compartment 42 may be discharged from the watercraft 10. A speed sensor 90 is also affixed to the port second stepper 78 for determining the speed of the watercraft 10 through the body of water in which the watercraft 10 is operating. As seen in FIG. 4, the second stepper 78 has a height C that is greater than the height D of the first stepper 76.

The larger height of the second stepper 78 allows for a longer aft end of the deck while minimizing the wetted area of the lower hull 14 when the watercraft is up on plane. The height of the second stepper 78, however, is not too large. The second stepper height desirably is selected such that the aft end of a second stepper area 92 behind the second stepper 78 either contacts or lies just above the surface of the water. In this position, the aft end of the lower hull 14 contacts the water to provide additional pitch stability if the watercraft starts to pitch from the desired planing angle of the watercraft bow.

The upper end of the second stepper 78 terminates at a second stepper area 92 that is bisected into port and starboard sections by the channel 80 and extend normally generally parallel to the port and starboard first stepper areas 84 and normal to the second stepper 78. As best seen in FIG. 3, the surface area of the second stepper area 92 is significantly less than the surface area of the first stepper area 84 while its length indicated by the letter B in FIG. 4 is generally equal to the length A of the first stepper area 84.

It is also seen in FIG. 4 that the rearward end 94 of the second stepper area 92 smoothly blends into the lower curved surface of the transom 40. The rounded lower end 94 of the transom 40 furthers the effect of the second stepper 78 without significantly affecting the buoyancy of the hull aft end.

As seen in FIG. 3, the second stepper 78 has a smaller lateral width than the first stepper 76. As a result, the watercraft can pivot about the planing surface of the lower hull 14 located near the first stepper 76 when turning without the stepper 78 interfering. The second stepper 78 thus effectively shortens the length of the hull when turning. That is, the watercraft tends to handle more like a smaller hull craft, even though the hull extends well beyond the location of the first stepper 76.

The above-described lower hull 14 functions in the following manner when the watercraft 10 is planing with the bow disposed at the optimum low drag angle relative to the level of the body of water in which the watercraft 10 is operating, indicated by the line L in FIG. 1. The first and second steppers 76 and 78 and first and second stepper areas 84 and 92 increase the effective length of the hull 14 of the watercraft 10 while reducing the overall wetted surface of the lower hull 14. This increases the stability of the watercraft 10 which thus inhibits bow pitching while also reducing the drag of the lower hull 14. The wetted surface of the lower hull 14 is reduced since the second stepper area 92 is at the height C above the first stepper area 84 which is sufficiently large to dispose the second stepper area 92 and the blended aft end 94 of the transom 40 generally above the water line L when the watercraft 10 is planing In static operating conditions the second stepper area 92 of length B provides buoyancy at the aft end of the watercraft 10.

As seen in FIG. 1 of the illustrated embodiment, the personal watercraft 10 also includes a pair of adjustable sponsons 96. A starboard side sponson 96 extends from the starboard side 74 of the lower hull section 14 and a port side sponson 96 extends from the port side 74 of the lower hull section 14. Each sponson 96 desirably is attached above the outer chine 70 on the corresponding side 74 of the lower hull section 14 of the watercraft 10. The sponsons 96 are positioned proximate the stern of the watercraft 10 and extend outwardly for increased buoyancy and stability. The angular orientation of the sponsons 96 relative to the outer chine 70 are desirably the same for both sponsons 96. However, the sponsons 96 can be set at different angular orientations to give the watercraft 10 different handling characteristics depending upon the turning direction.

It is contemplated that the structure of port and starboard side adjustable sponsons 96 will be identical apart from the sponson bodies being mirror images of each other. The description herein of one of adjustable sponson therefore will be understood as applying equally to both unless specified to the contrary.

Figure 5:
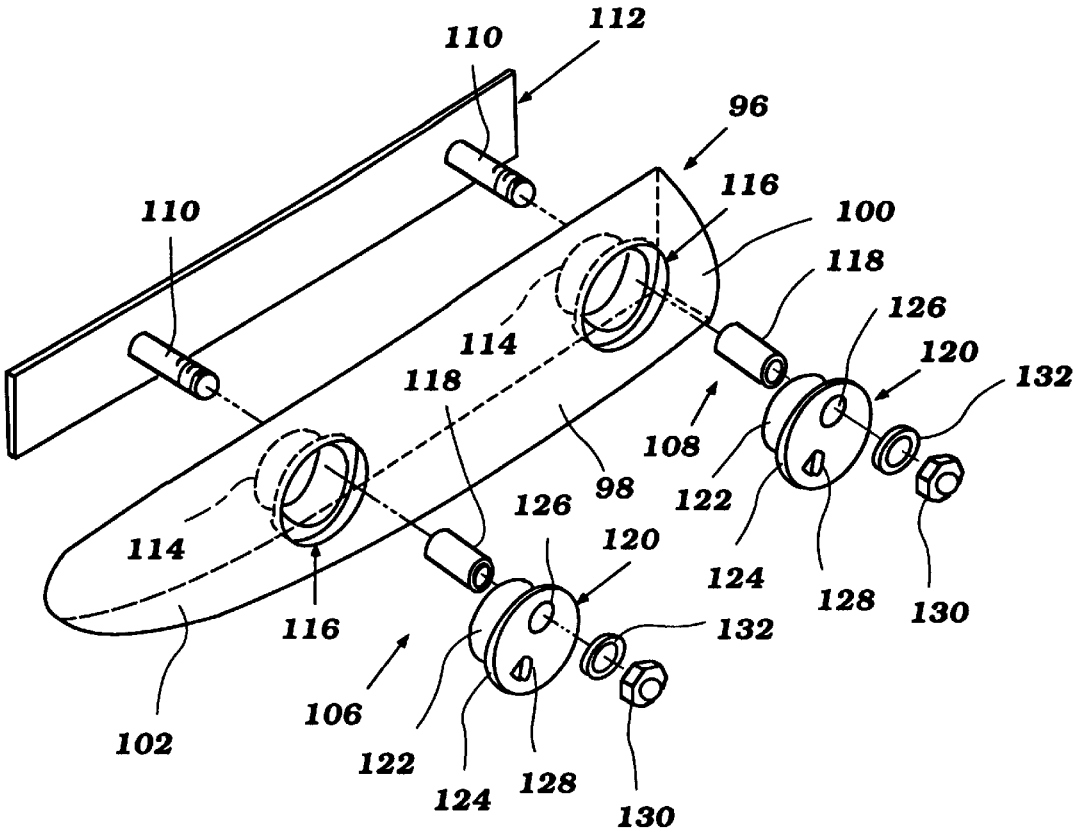
FIG. 5 is a perspective view of a sponson constructed in accordance with an embodiment of the invention.
Figure 6:
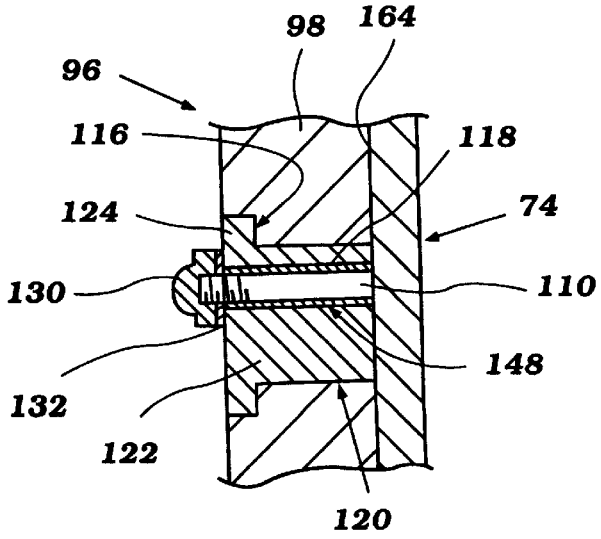
FIG. 6 is a cross-sectional view of a mounting arrangement for the sponson of FIG. 5.

With reference now to FIGS. 5 and 6, it is seen that the sponson 96 has an elongated rib-like body 98 with a length substantially shorter than the length of the hull 12. In the illustrated embodiment, the sponson 96 has a length roughly equal to about a quarter of the length of the watercraft 10.

The shape of the sponson body 98 tapers from its aft end 100 to a generally blunt nose 102 positioned at the fore end to give the body a substantially streamlined shape in the direction of water flow over the sponson 96. In other words, the lateral width of the sponson body 98 increases from its blunt nose 102 to its aft end 100.

The outer portion of the sponson body 98 also tapers in size in the vertical direction such that the outer portion smoothly transitions into the blunt nose 102 of the sponson 96 in the forward direction. That is, the degree to which the sponson body 98 protrudes downwards decreases gradually towards its fore end 102 and blends smoothly into the fore end 102.

The size and shape of the sponson body 98 desirably is selected according to the preference of the particular rider and the number of riders. It is contemplated that other shapes and sizes of the sponson body 98 can be used.

As best seen in FIG. 6, the sponson body 98 includes a generally flat inner mounting surface 104 which abuts the sides 74 of the lower hull section 14 when assembled. A coupling mechanism of the adjustable sponson 96 couples the sponson body 98 to the lower hull section 14 and allows for adjustment of the angular orientation and position of the sponson body 98 relative to the corresponding outer chine 70 of the lower hull section 14 as described below and additionally serves as a locking device for the sponson 96.

In the illustrated embodiment, the coupling mechanism includes a front coupling 106 and an aft coupling 108. The couplings 106 and 108 of the coupling mechanism allow the sponson body 98 to move relative to the watercraft hull side 74 to adjust the angular orientation of the sponson body 98.

The coupling mechanisms 106 and 108 include threaded studs 110 which are integrally formed in the fore and aft ends of a mounting plate 112. The studs 110 extend outwardly through apertures formed in the side wall 74 of the lower hull section 14 while the mounting plate 112 lies inside the lower hull 14 adjacent to the side wall 74 to reinforce the side wall 74 at this location. The diameter of the apertures formed in the side walls 74 desirably are generally equal in size to the diameter of the portion of the studs 110 extending through the side wall 74. The generally tight fit between the studs 110 and the side wall apertures inhibit water flow into the lower hull 14 through the apertures. Although not illustrated grommets or O-rings can be placed about or into the apertures to improve the seal between the studs 110 and the side wall 74.

The outer threaded ends of the studs 110 extends through holes 114 formed at the fore and aft ends 102 and 100 of the sponson body 98. The holes 114 extend into the sponson body 98 from the generally flat inner mounting surface 104 of the sponson body 98 and opens into counterbore recesses 116. The recesses 116 extend into the sponson body 98 from the outer side of the sponson body 98 opposite of the holes 114.

Spacers 118 are placed in the holes 114 over the studs 110. The inner ends of the spacers 118 abut the side wall 74 of the lower hull 14 while their outer ends extend slightly beyond the inner surface of the recesses 116. Fore and aft cam members 120 are rotatably journaled in the holes 114 and include main body portions 122 and flange portions 124 that are disposed within the fore and aft recesses 114 of the sponson body 98. The cam members 120 are provided with eccentrically positioned holes 126 through which the spacers 118 extend. Thus, the spacers 118 provide bearing surfaces about which the fore and aft cam members 120 can rotate in an eccentric manner.

The outer surfaces of the cam members 120 are provided with tabs 128 by which a rider of the associated watercraft 10 may manipulate the orientation of the cam members 120. Forward and aft locking nuts 130 threadingly engage the threaded outer ends of the studs 110 for holding the cam members 120 within the sponson body holes 114. Additionally, washers 132 are interposed on the studs 110 whose outer sides contact the locking nuts 130 and whose inner sides press against the spacers 118 and cam members 120 so as to lock the cam members 120 in a desired orientation.

The above-described fore and aft locking mechanisms 106 and 108 permit the variation of the position of the sponson 96 along and angular orientation relative to the lower hull 14 in the following manner. Loosening the locking nut 130 allows the rider to rotate the eccentrically mounted cam members 120 about the studs 110 using the tabs 128. Since the cam members 120 are eccentrically mounted, rotation of the cam members 120 causes the associated ends of the sponson body 98 to follow the track of the longitudinal axis of the cam members 120 about the studs 110, and thus vary the position and angular orientation of the sponson 96. It is to be noted that since the distance between the centers of the fore and aft sponson body holes 114 is constant, the combined rotations of the fore and aft cam members 120 must be such that the distance between their longitudinal axes is always equal to the fore/aft sponson hole distance.

Thus, it is seen that rotating the forward and aft cam members 120 in unison by identical amounts moves the sponson body 98 in the longitudinal and vertical directions along the lower hull side wall 74 without affecting the angular orientation of the sponson 96 relative to the lower hull 14. Rotating the fore and aft cam members 120 in opposition by any amounts which maintain the desired fixed distance between their longitudinal axes changes the angle of orientation of the sponson 96 relative to lower hull 14 and outer chine 70.

The angle of the sponson 96 relative to the outer chine 70 affects the stability and handling characteristics of the watercraft 10. A pronounced positive angle, i.e., the fore end 102 positioned above the aft end 100, helps maintain the bow of the personal watercraft 10 just above the water surface when planing. This effect consequently inhibits porpoising of the bow to maximize boat speed. Too large of an angle, however, can tend to force the bow down too far and substantially dig into wakes and chops in the water, producing an unpleasant ride. The optimum angle varies depending upon the rider's size, i.e., the loading on a personal watercraft 10, and the water conditions. This will also give the personal watercraft 10 more aggressive turning characteristics and responsiveness.

The ability to change the angular orientation of the sponsons 96 thus allows each rider to change the riding characteristics of the watercraft 10. The positive angular orientation of the sponson 96 can easily be adjusted to improve the ride of the watercraft 10 for the particular size of the rider. The sponsons 96 also can readily be set in a slightly negative angular orientation to improve top-end performance of the watercraft 10 when up on a plane.

Figure 7:
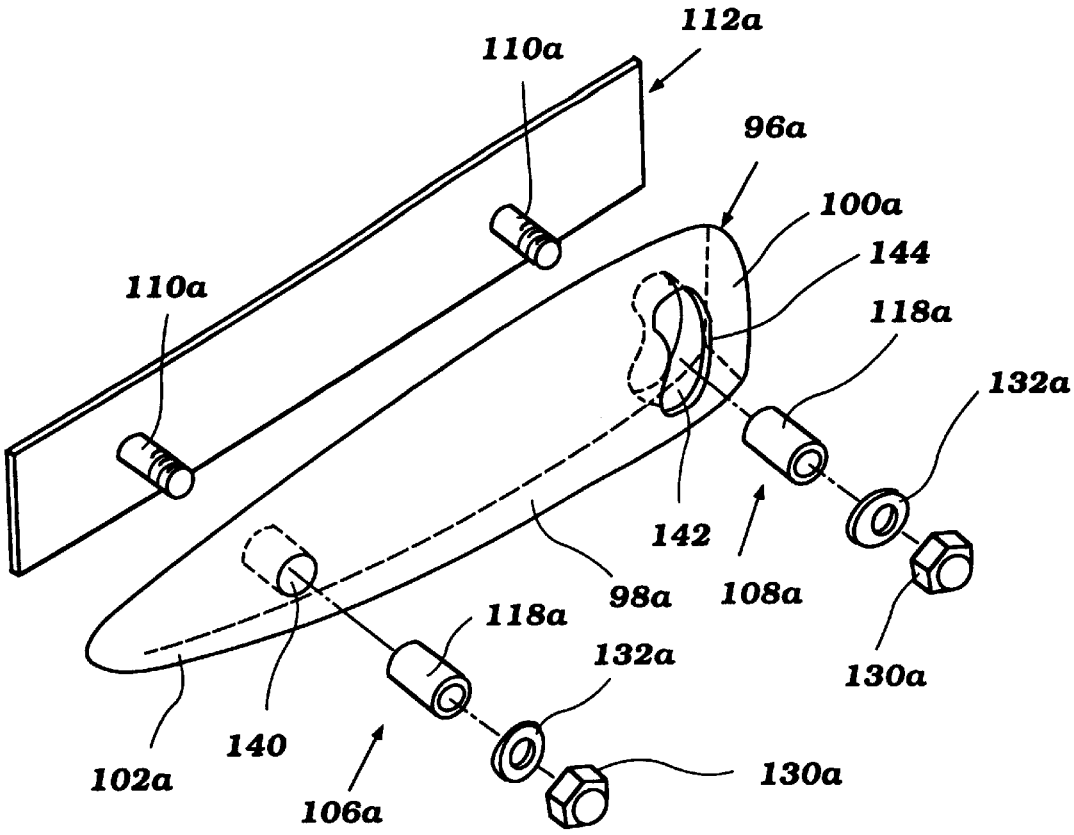
FIG. 7 is a perspective view similar to FIG. 5 and illustrates a further sponson constructed in accordance with an embodiment of the invention.
Figure 8:
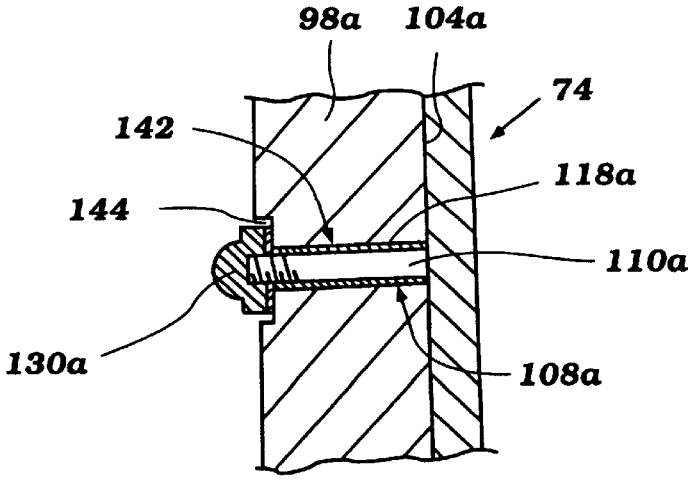
FIG. 8 is a cross-sectional view similar to FIG. 6 and illustrates a rear mounting arrangement for the sponson of FIG. 7.

FIGS. 7 and 8 illustrate an adjustable sponson configured in accordance with another embodiment of the present invention. The adjustable sponson is similar in many respects to the adjustable sponson described above. The differences mainly reside in the configuration of the couplings. Because many of the components of the adjustable sponson of this embodiment are the same or are substantially similar to those of FIGS. 5 and 6, like reference numbers with an "a" suffix will be used to indicate like components.

In the illustrated embodiment, the coupling mechanism includes a front coupling 106*a* and an aft coupling 108*a*. These couplings 106*a* and 108*a* allow for the angular orientation of the sponson body 98*a* to be varied. The front coupling mechanism 106*a* includes a threaded stud 110*a* which is integrally formed on the front end of a mounting plate 112*a*. The stud 110*a* extends outwardly through an aperture formed in the side wall 74 of the lower hull 14, while the mounting plate 112*a* lies inside the lower hull 14 adjacent to the side wall 74. The diameter of the aperture formed in the side wall 74 desirably is generally equal to the diameter of the stud 110*a* so as to inhibit water flow into the lower hull 14 through the aperture. Although not illustrated, a grommet or O-ring can be placed about or in the aperture to improve the seal between the stud 110*a* and the side wall 74.

The outer threaded end of the stud 110*a* extends through a hole 140 formed at the fore end of the sponson body 98*a*. The hole 140 extends into the sponson body 98*a* from the flat inner mounting surface 104*a* and opens to the outer surface of the sponson body 98*a*. A spacer 118*a* is placed in the hole 140 over the stud 110*a* and provides a bearing surface about which the fore end 102*a* of the sponson body 98*a* can rotate. The inner end of the spacer 118*a* abuts the side wall 74, while its outer end extends slightly beyond the outer end of the hole 140.

A locking nut 130*a* threadingly engages the outer end of the stud 110*a* while a washer 132*a* is interposed between the locking nut 130*a* and the spacer 118*a* so as to hold the fore end 102*a* of the sponson body 98*a* in close proximity to the side wall 74 while permitting the sponson body 98*a* to rotate about the longitudinal axis of the forward stud 110*a*.

The aft coupling mechanism 108*a* includes an aft threaded stud 110*a* that is integrally formed within the mounting plate 112*a* and extends through an aperture formed in the side wall 74. The diameter of the aperture is generally equal to the diameter of the stud 110*a* so as to inhibit water flow into the lower hull 14. Additionally, a grommet or O-ring seal can be associated with the aperture so as to improve the seal between the aft stud 110*a* and the side wall 74.

The outer threaded end of the aft stud 110*a* extends through a curved slot 142 formed in the aft end of the sponson body 98*a*. The slot 142 extends through the sponson body 98*a* from the flat inner mounting surface 104*a* and opens to a recess 144 formed in the outer aft surface of the sponson body 98*a*. An aft spacer 118*a* is positioned in the slot 142 over the aft stud 110*a* and abuts the side wall 74 at its inner end. The outer end of the aft spacer 118*a* terminates at the lower surface of the recess 144 in the sponson body 98*a*.

An aft locking nut 130*a* threadingly engages the outer end of the aft stud 110*a*, while an aft washer 132*a* is interposed between the locking nut 130*a* and the spacer 118*a* and lower surface of the recess 144 and presses against the recess lower surface so as to hold the aft end 100*a* of the sponson body 98*a* in a fixed position along the side wall 74. Thus, the aft coupling mechanism 108*a* serves as a locking mechanism for the sponson 96*a*.

The angular orientation for the above sponson 96*a* relative to the lower hull 14 may be varied in the following manner. Loosening the aft locking nut 130*a* allows the sponson body 98*a* to be rotated about the longitudinal axis of the forward stud 110*a* through an infinite number of angular variations bounded between the upper and lower extensions of the aft slot 142. Once a desired sponson orientation is set, the sponson 96*a* is held in position relative to the lower hull 14 by tightening the aft locking nut 130*a*.

Figure 9:
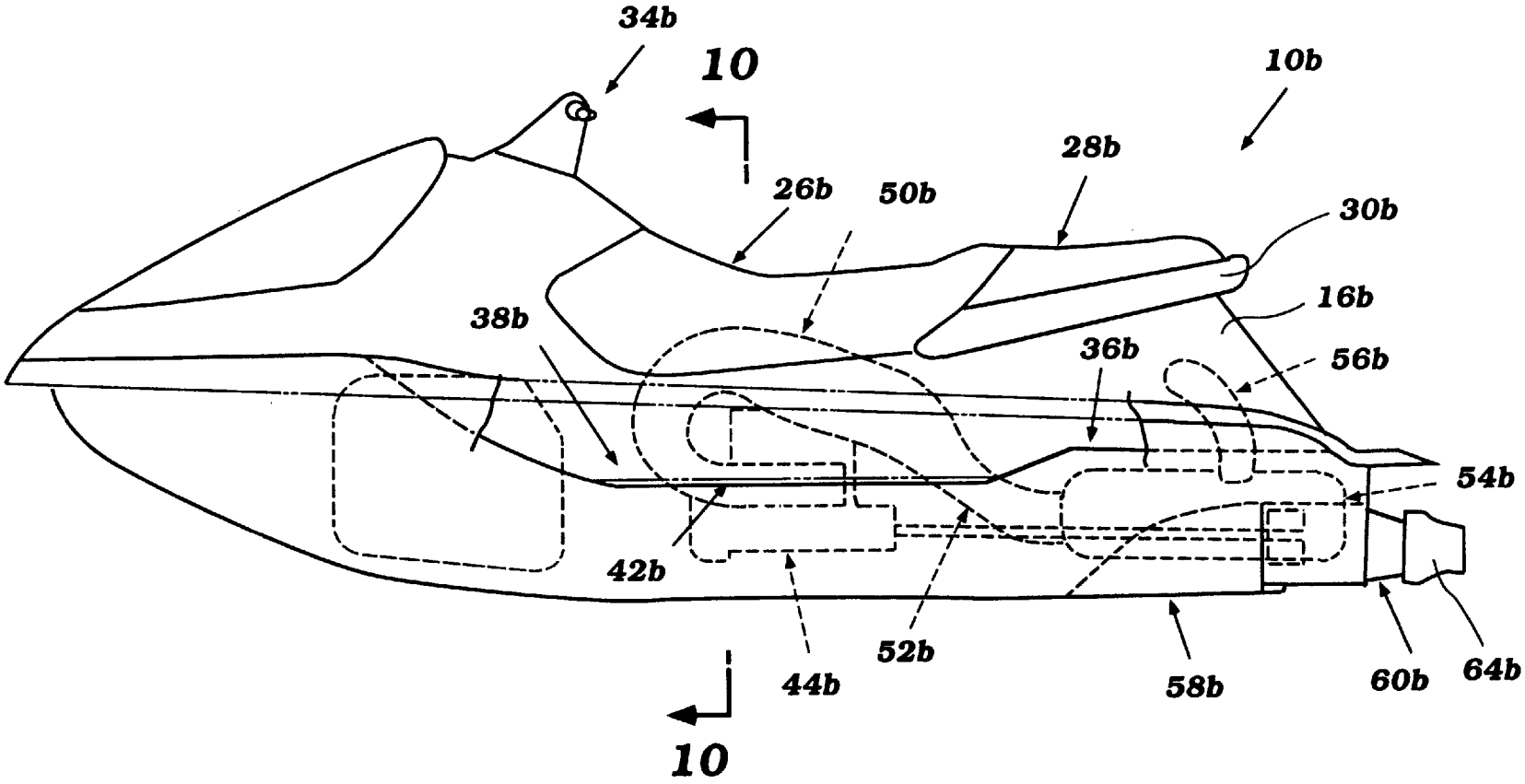
FIG. 9 is a side elevational view of a watercraft similar in construction to the watercraft of FIGS. 1–4 and illustrates a foot area configuration for the watercraft.
Figure 10:
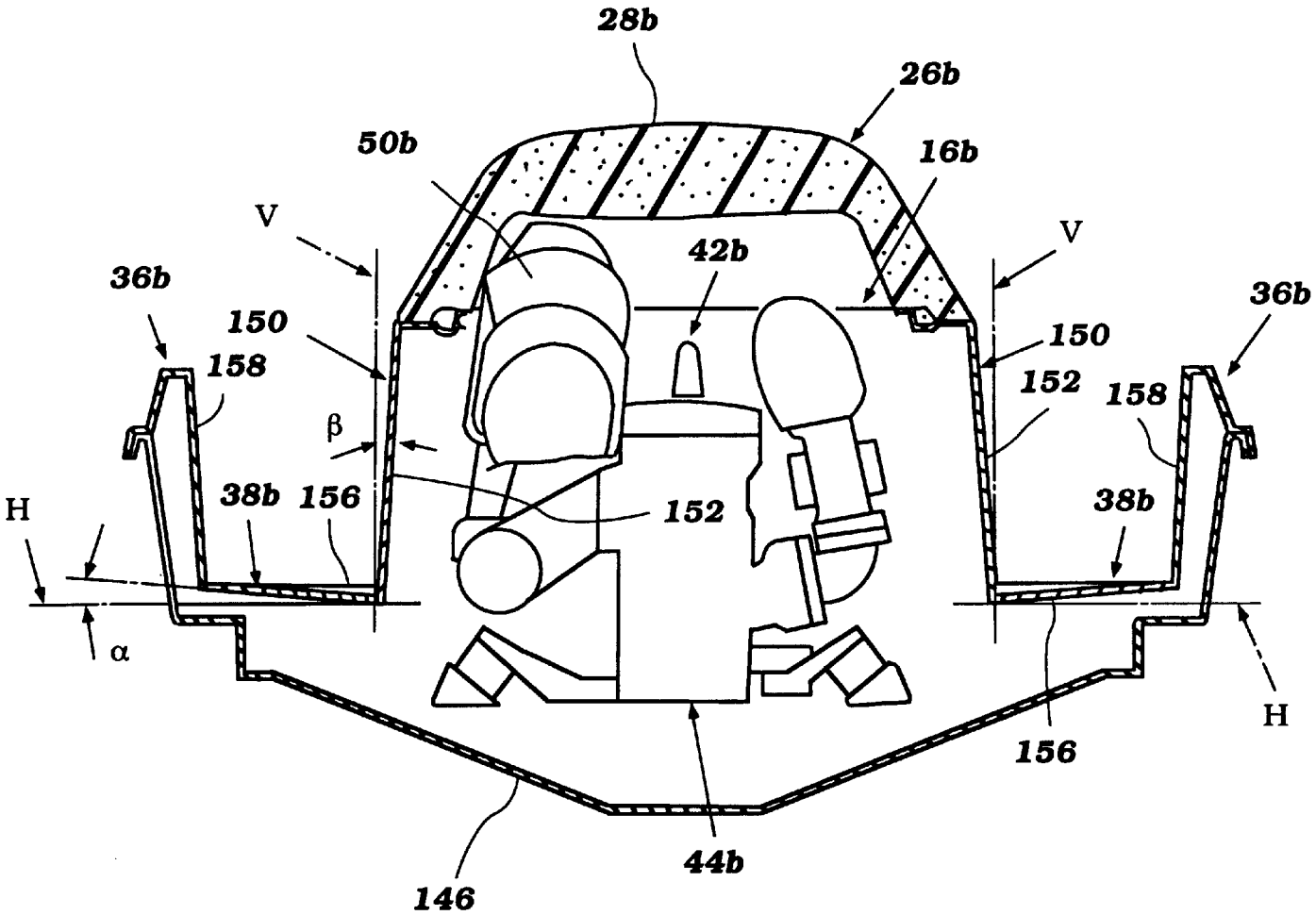
FIG. 10 is a cross-sectional view taken along line 10—10 of FIG. 9.

FIGS. 9 and 10 illustrate a small personal watercraft that is similar in construction to the watercraft of FIGS. 1–4. Hence, the reference numerals with a "b" suffix will be used to indicate the like components. The rider's area 26 of the watercraft 10*b* has been modified so as to permit a rider increased leverage when maneuvering the watercraft 10*b*.

As best seen in FIG. 10, the rider's area 26*b* includes the seat 28*b* that is situated atop a rider pedestal portion of the upper deck 16*b* that is indicated by the reference numeral 150 and defines the inner walls 152 of the foot areas 38*b*. These walls 152 extend upwardly and inwardly from the foot areas 38*b* at an angle β from a vertical axes V which extends upwardly parallel to the vertical center line of the watercraft 10*b*. The angle β typically falls in the range of 3–10 degrees in the practice of the invention. As a result, the seat has a narrow width which improves the rider's comfort. It also makes it easier for the rider to shift his or her weight.

Angularly-oriented step surfaces or foot steps 156 extend outwardly and upwardly from the lower edges 160 of the walls 152 at an angle a from the horizontal axis H and serve as footrest for the rider or riders to place their feet when operating the watercraft 10*b*. The angle a desirably is about 5° though it is understood that other values for angle α may be employed in the practice of the invention.

The step surfaces 156 terminate at lower edges 162 of the outer walls 158 which extend upwardly and include the inner walls of the raised gunnels 36*b*. It is also understood that the foot steps 156 also can include included segments 164 which have a greater angular orientation than the foot step near the pedestal wall lower edge 160. FIG. 10 illustrates the angular segments 164 in phantom line. These outer inclined segments 164 also can be used with generally horizontal foot steps. The greater angular orientation gives the rider additional leverage when leaning the watercraft in a turn.

In addition to the enhancing the riders leverage on the watercraft, the angular orientation of the foot steps 156 also direct any water W within the foot areas 38*b* toward the pedestal walls 152, as schematically illustrated in FIG. 10. As a result, the outer portion of the foot steps 156 tend remain uncovered by water to enhance the rider's control of the watercraft 10. The rider's foot is less likely to slip on the relatively dry outer portion of the foot step 156.

The angularly oriented seat pedestal sidewalls 152 and foot areas 156 allow the rider of the watercraft 10*b* to apply greater leverage when maneuvering the watercraft 10*b* by positioning the rider's legs and feet at an orientation that is more suitable for maneuvering the watercraft. Thus, greater control of the watercraft is achieved resulting in more vigorous ride for the rider or riders.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull formed by an upper deck and a lower hull, the lower hull including a pair of inclined sections arranged generally in a V-shape, the inclined sections extending from a bow of the watercraft toward a transom of the watercraft, and first and second steppers being formed in the lower hull with first and second stepper areas being formed on the aft side of the first and second stepper respectively, and a propulsion device carried by the hull, the propulsion device including an inlet opening arranged on the underside of the lower hull, the first and second steppers being formed in the lower hull between a fore end of the inlet opening of the propulsion device and the transom of the watercraft.

2. A small watercraft as in claim 1, wherein a height of the second stepper is greater than a height of the first stepper.

3. A small watercraft as in claim 1, wherein a width of the first stepper is greater than a width of the second stepper.

4. A small watercraft as in claim 1, wherein the first stepper extends upwardly in a direction normal to the aft ends of the inclined sections.

5. A small watercraft as in claim 4, wherein the second stepper extends upwardly in a direction generally parallel to the direction in which the first stepper extends.

6. A small watercraft as in claim 1, wherein a channel formed in the lower hull bisects the first and second steppers and the first stepper area.

7. A small watercraft as in claim 6, wherein one side of the first stepper area lies generally parallel to an aft portion of the corresponding inclined section of the lower hull, and the other side of the first stepper area lies generally parallel to an aft portion of the other corresponding inclined section of the lower hull.

8. A small watercraft as in claim 1, wherein the first stepper area lies generally normal to the first and second steppers.

9. A small watercraft as in claim 1, wherein the surface area of the second stepper area is smaller than the surface area of the first stepper area.

10. A small watercraft as in claim 1, wherein a channel bisects at least the second stepper area and the transom includes a rounded lower end portions which blend into the second stepper area on either side of the channel.

11. A small watercraft as in claim 1, wherein a length of the first stepper area generally equals to a length of the second stepper area.

12. A small watercraft as in claim 1, wherein each inclined section of the lower hull extends outwardly in a lateral direction generally from a keel line to an outer chine formed between the inclined section and a side wall of the lower hull, and the inclined section is disposed at a dead rise angle.

13. A small watercraft as in claim 12, wherein a channel is formed on an underside of the lower hull, the channel extends into the lower hull from the transom and bisects the first and second steppers and the first and second stepper areas, and extends between at least a portion of the inclined hull sections.

14. A small watercraft as in claim 13, wherein the portions of the first and second stepper areas on each side of the channel are angularly disposed at the same dead rise angle as the corresponding inclined section of the lower hull.

15. A small watercraft as in claim 12 additionally comprising a pair of adjustable sponsons, each sponson being positioned on one side wall of the hull opposite the other sponson.

16. A small watercraft as in claim 15, wherein at least an aft end of each sponson is movable in a generally vertical direction.

17. A small watercraft as in claim 16, wherein a fore end of each sponson also is movable in a generally vertical direction.

18. A small watercraft as in claim 15, wherein each sponson includes a cam member operating between the corresponding side wall of the watercraft hull and a body of the sponson.

19. A small watercraft as in claim 1, wherein the upper deck of the hull includes a pair of longitudinally extending foot areas each of which includes a step surface, at least a portion of the step surface being angularly orientated to slope upwardly, away from a longitudinal centerline of the watercraft.

20. A small watercraft as in claim 19, wherein the entire step surface has an angular orientation in an outwardly direction, away from the longitudinal centerline.

21. A small watercraft as in claim 19, wherein the inclined portion of the step surface is disposed toward an outer side of the foot area.

22. A small watercraft as in claim 1, wherein at least one drain hole is located on the second stepper.

23. The small watercraft of claim 1 further comprising a channel in which at least a portion of the propulsion device is located.

24. The small watercraft of claim 1 wherein the second stepper is arranged between the first stepper and the transom.

25. The small watercraft as in claim 23, wherein the channel extends through both the first and second stepper areas, and the propulsion device is arranged within the channel so as be arranged above the first stepper area.

26. The small watercraft as in claim 25, wherein the second stepper area is formed relative to the channel so as to be arranged higher on the hull that at least a portion of the propulsion device with the portion of the propulsion device mounted within the channel.

27. The small watercraft as in claim 26, wherein the intersection between the second stepper area and the transom is rounded.

28. A small watercraft including a hull formed by an upper deck and a lower hull, the lower hull including a pair of inclined sections arranged generally in a V-shape, the inclined sections extending in a longitudinal direction from a bow of the watercraft toward a transom on either side of a centerline of the watercraft, the deck including a pair of longitudinally extending foot areas, each foot area being located on a side of the longitudinal centerline opposite the other foot area and including foot step, at least a portion of the foot step being inclined to slope upwardly in a direction away from the longitudinally centerline.

29. A small watercraft as in claim 28, wherein each foot area is formed between a side of a seat pedestal and a corresponding outer wall of the upper deck with the foot step extending between the bottom edge of the seat pedestal side and a lower edge of the corresponding outer wall.

30. A small watercraft as in claim 29, wherein the bottom edge of the seat pedestal side is lower than the lower edge of the corresponding wall.

31. A small watercraft as in claim 29, wherein the entire surface of the foot step surface slopes upwardly from the bottom edge of the seat pedestal to the lower edge of the corresponding outer wall.

32. A small watercraft as in claim 31, wherein each foot step slopes upward at about a 5° angle relative to a horizontal plane.

33. A small watercraft as in claim 24, wherein the side of the seat pedestal slopes inwardly, toward the centerline of the watercraft, in an upward direction.

34. A small watercraft as in claim 32, wherein the seat pedestal side slopes inwardly at an angle ranging generally between about 3° and 10°.

35. A small watercraft as in claim 29, wherein the inclined portion of the step surface is located near the corresponding outer wall of the upper deck.

36. A small watercraft as in claim 28, wherein the lower hull includes first and second steppers formed between aft ends of the inclined sections and the transom of the watercraft.

37. A small watercraft as in claim 36, wherein a height of the second stepper is greater than a height of the first stepper.

38. A small watercraft as in claim 36, wherein at least one drain hole is located on the second stepper.

39. A small watercraft comprising a hull including at least one adjustable sponson, the adjustable sponson comprising an body movably attached to a side wall of the watercraft hull by at least one cam mechanism, the cam mechanism including a support pin projecting from a side wall of the hull and a cam member, the cam member including an eccentrically positioned hole through which the pin extends, and a locking device positioned on a side of the sponson body opposite of the side wall of the hull to secure the sponson body onto the side wall.

40. A small watercraft as in claim 34, wherein the locking device includes an annular flange which circumscribes an outer end of the cam member and a fastener which cooperates with an outer end of pin.

41. A small watercraft as in claim 34, wherein the hull includes a lower hull of which the side wall forms a portion thereof, and the lower hull additionally including a pair of inclined sections arranged generally in a V-shape, the inclined sections extending from a bow of the watercraft toward a transom of the watercraft, and at least one stepper being formed in the lower hull between aft ends of the inclined sections and the transom of the watercraft.

42. A small watercraft as in claim 41, wherein the lower hull includes another stepper positioned between the aft ends of the inclined sections and the transom of the watercraft.

43. A small watercraft as in claim 41, wherein the stepper closest to the transom has a height greater than a height of the stepper closest to the aft ends of the inclined sections of the lower hull.

44. A small watercraft comprising a centrally located longitudinal extending seat supported by a hull, the hull formed by an upper deck and a lower hull, the lower hull including, a pair of inclined sections arranged generally in a V-shape, the inclined sections extending in a longitudinal direction from a bow of the watercraft toward a transom of the watercraft, at least a section of the inclined sections extending outward in a lateral direction from a generally flat section of the keel, and first and second steppers being formed in the lower hull with steppers areas being formed on aft sides of each stepper, the steppers and the stepper areas lying between aft ends of the inclined sections and the transom of the watercraft.

45. A small watercraft as in claim 44, wherein a height of the second stepper is greater than a height of the first stepper.

46. A small watercraft as in claim 44, wherein a width of the first stepper is greater than a width of the second stepper.

47. A small watercraft as in claim 44, wherein the first stepper extends upwardly in a direction normal to the aft ends of the inclined sections.

48. A small watercraft comprising a hull formed by an upper deck and a lower hull and having a center of gravity between a bow and a transom of the watercraft, the lower hull including a pair of inclined sections, at least first and second steppers, and stepper areas formed on the aft side of each stepper, the inclined sections being arranged generally in a V-shape and extending from the bow toward the transom, being disposed on the lower hull the steppers only on the aft side of the center of gravity, the first and second steppers lying between aft ends of the inclined sections and the transom of the watercraft, the second stepper arranged between the first stepper and the transom, and the second stepper having a generally uniform height greater than a generally uniform height of the first stepper.

49. A small watercraft as in claim 48, wherein the inclined sections of the lower hull extend outwardly relative to a keel line of the lower hull, and each stepper area lies in a plane generally parallel to the keel line of the lower hull.

50. A small watercraft as in claim 49, wherein at least one of the stepper areas lies in a plane generally parallel to at least one of the inclined sections.

51. A small watercraft as in claim 48, wherein the hull includes a longitudinally extending channel, and the stepper areas lie generally parallel to a longitudinal axis of the channel.

52. A small watercraft as in claim 48, wherein the inclined sections terminate at the first stepper and each inclined section has a surface portion having no steppers between the bow and the first stepper.

53. A small watercraft comprising a hull formed by an upper deck and a lower hull, the lower hull including a pair of inclined sections arranged generally in a V-shape, the inclined sections extending from a bow of the watercraft toward a transom of the watercraft, first and second steppers being formed in the lower hull between aft ends of the inclined sections and the transom of the watercraft, the second stepper arranged between the first stepper and the transom, the second stepper having a width smaller than a width of the first stepper, and first and second stepper areas formed in the lower hull on the aft side of the first and second stepper, respectively.

* * * * *